US006217422B1

(12) United States Patent
Franca et al.

(10) Patent No.: US 6,217,422 B1
(45) Date of Patent: Apr. 17, 2001

(54) LIGHT ENERGY CLEANING OF POLISHING PADS

(75) Inventors: Daniel L. Franca, Poughkeepsie; Raymond M. Khoury, Wappinger Falls; Jose M. Ocasio, Maybrook; Uldis A. Ziemins, Poughkeepsie, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/233,886

(22) Filed: Jan. 20, 1999

(51) Int. Cl.[7] ..... B24B 1/00
(52) U.S. Cl. ..... 451/56; 451/60; 451/444
(58) Field of Search ..... 451/56, 59, 60, 451/72, 443, 444, 41; 134/1.3

(56) References Cited

U.S. PATENT DOCUMENTS

| | | | | |
|---|---|---|---|---|
| 5,023,424 | * | 6/1991 | Vaught | 219/121.6 |
| 5,024,968 | * | 6/1991 | Engelsberg | 437/173 |
| 5,151,134 | * | 9/1992 | Boquillon et al. | 134/1 |
| 5,151,135 | * | 9/1992 | Magee et al. | 134/1 |
| 5,216,843 | | 6/1993 | Brievogel et al. . | |
| 5,291,693 | * | 3/1994 | Nguyen | 51/283 R |
| 5,313,043 | | 5/1994 | Yamagishi . | |
| 5,329,734 | | 7/1994 | Yu . | |
| 5,373,140 | * | 12/1994 | Nagy et al. | 219/121.85 |
| 5,482,561 | * | 1/1996 | Yeung et al. | 134/1 |
| 5,578,362 | | 11/1996 | Reinhardt et al. . | |
| 5,584,146 | | 12/1996 | Shamouillan et al. . | |
| 5,620,618 | | 4/1997 | Freedenberg et al. . | |
| 5,643,472 | * | 7/1997 | Engelsberg et al. | 216/65 |
| 5,669,979 | * | 9/1997 | Elliott et al. | 134/1 |
| 5,957,757 | * | 9/1999 | Berman | 451/56 |

FOREIGN PATENT DOCUMENTS 53-125861 10/1978 (JP) .

* cited by examiner

*Primary Examiner*—Timothy V. Eley
*Assistant Examiner*—Dung Van Nguyen
(74) *Attorney, Agent, or Firm*—Pollock, Vande Sande & Amernick

(57) ABSTRACT

A method and apparatus for cleaning polishing debris from the surface of a polishing pad by wetting the surface with a liquid and irradiating the wetted surface with a beam of light. The light beam has sufficient intensity at the polishing surface of the pad to vaporize at least a portion of the liquid such that the vaporized liquid causes at least a portion of the debris to be expelled from the polishing surface of the pad.

25 Claims, 6 Drawing Sheets

LIGHT ENERGY CLEANING OF POLISHING PADS

FIELD OF THE INVENTION

The present invention relates to the field of cleaning polishing pads, and more specifically to cleaning polishing pads used in chemical-mechanical planarization (CMP) of semiconductor substrates.

BACKGROUND OF THE INVENTION

Chemical-mechanical polishing has been used for many years as a technique for polishing optical lenses and semiconductor wafers. More recently, chemical-mechanical polishing has been developed as a means for planarizing intermetal dielectric layers of silicon dioxide and for removing portions of conductive layers within integrated circuit devices as they are fabricated on various substrates. For example, a silicon dioxide layer may cover a metal interconnect conformably such that the upper surface of the silicon dioxide layer is characterized by a series of non-planar steps corresponding in height and width to the underlying metal interconnects.

The step height variations in the upper surface of the intermetal dielectric layer have several undesirable characteristics. Such non-planar dielectric surfaces may interfere with the optical resolution of subsequent photolithographic processing steps, making it extremely difficult to print high resolution lines. Another problem involves the step created in the coverage of a second metal layer over the intermetal dielectric layer. If the step height is relatively large, the metal coverage may be incomplete such that open circuits may be formed in the second metal layer.

To combat these problems, various techniques have been developed to planarize the upper surface of the intermetal dielectric layer. One such approach is to employ abrasive polishing to remove the protruding steps along the upper surface of the dielectric layer. According to this method, a silicon substrate wafer is mounted face down beneath a carrier and pressed between the carrier and a table or platen covered with a flat pad continuously covered with a slurried abrasive material (in FIG. 1, a prior art abrasive disk and holder are shown in the same position as such a wafer and carrier).

Means are also provided for depositing the abrasive slurry on the upper surface of the pad and for forcibly pressing the substrate wafer against the polishing pad, such that relative movement of the platen and the substrate wafer relative to each other in the presence of the slurry results in planarization of the contacted face of the wafer. Both the wafer and the table may be rotated relative to each other to rub away the protruding steps. This abrasive polishing process is continued until the upper surface of the dielectric layer is substantially flat.

Conventional polishing pads may be made of a uniform material such as polyurethane or may be formed from multilayer laminations having non-uniform physical properties throughout the thickness of the pad. Polyurethane polishing pads are typically formed by reacting the reagents that form polyurethane within a cylindrical container. After forming, a cylindrically shaped piece of polyurethane is cut into slices that are subsequently used as the polishing pad. A typical laminated pad may have a plurality of layers, such as a spongy and resilient microporous polyurethane layer laminated onto a firm but resilient supporting layer comprising a porous polyester felt with a polyurethane binder. Polishing pads typically may have pores that have a size of about 100–200 microns.

Conventional polishing pads typically may also have microtextured surfaces resulting from a microscopic bulk texture of the pad resulting from factors intrinsic to the manufacturing process. Some of the factors which influence the microscopic bulk texture of a conventional pad are the nature or texture of the work surface, such as waves, holes, creases, ridges, slits, depressions, protrusions, gaps or other spaces, and the size, shape and distribution frequency or spacing of such features. Since polishing does not normally occur across the entire pad surface, the microtexture of the pad or any macrotextures made by surface machining, may only be formed into the portion of the pad over which polishing is to take place.

During the polishing process, the material removed from the wafer surface and the abrasive, such as silica, in the slurry become embedded in the pores and other free spaces within the microscopic and macroscopic bulk texture of the polishing pad at and near its surface. One factor in achieving and maintaining a high and stable polishing rate is providing and maintaining the pad in a clean condition. Pad cleaning or reconditioning is a technique whereby the pad surface is returned to a proper state for subsequent polishing work. The purpose of the cleaning method selected is to remove the contaminating particles of wafer, abrasive or other debris from the free spaces or interstices at or slightly below the pad surface. Prior art cleaning techniques include diamond grit conditioners that grind away the contaminated layer of the pad, thereby removing the contaminants along with a portion of the pad material itself.

FIG. 1 is an illustration of using a diamond grit conditioner to clean a polishing pad 10 attached to a platen 14. Above the polishing pad 10 is a holder 12 for carrying a diamond grit disk 11 and pressing it against the contaminated face 13 of the polishing pad 10. During reconditioning, the carrier 12 is rotated by drive shaft 15 and the platen 14 is rotated by drive shaft 16. The carrier 12 and the platen 14 may rotate either clockwise or counterclockwise, but typically the carrier 12 rotates in the same direction as the platen 14. While the carrier and platen are rotated, the carrier 12 may be oscillated back and forth across the polishing pad as indicated by the arrow O. In this direct contact reconditioning technique, the abrasive disk 11 and the carrier 12 are essentially substituted for the respective wafer and its carrier mentioned in the prior art planarization technique also described above.

Obviously, such direct contact processes significantly reduce the life of the polishing pad. To avoid such degradation of the pad, other prior art techniques include using a water knife or an air knife in an attempt to blow away the contaminants. However, the water or air velocities required for effectiveness are such that substantial portions of the pad adjacent to its surface may also be removed or damaged.

It has also been determined that ineffective reconditioning of the polishing pad has a direct correlation to the amount of scratching caused to a wafer surface by polishing with the poorly reconditioned pad. This in turn causes significant losses in the yield of semiconductor wafers. Thus, the consistency and quality of polishing pad reconditioning by prior processes has presented two problems. The first of these is the reduction in polishing pad life due to the destructive nature of the reconditioning techniques previously available. Secondly, the poor quality of polishing pad reconditioning provided by prior art processes has resulted in a relatively high loss of product yield due to wafer damage caused by the reconditioning technique. Therefore, there is a need for a polishing pad reconditioning process of higher quality and consistency than provided by prior art processes.

SUMMARY OF INVENTION

The present invention provides a cleaning method for achieving a high quality and consistency of polishing pad reconditioning by the use of a laser or other collimated light source. A beam of high intensity light from the light source is projected onto the surface of the pad while the pad is rotated on a supporting surface, which may be the same table or platen on which the pad is mounted for polishing the surface of semiconductor wafers. The projected beam may be moved radially relative to the rotating pad by moving the optical system relative to the rotational axis of the platen or by using a scanning beam delivery system. Regardless of how the light beam is moved relative to the pad surface, the light beam is concentrated so as to maintain a relatively uniform and high energy density over a relatively small area of the pad surface while the pad rotates past this irradiated area.

The light energy is applied to the pad surface in the presence of water or another liquid to generate steam or vapor to assist in the cleaning process. The steam or vapor generated acts to dislodge particulates embedded in the thin contaminated layer of the pad adjacent to its surface. The resultant steam or vapor cleaning dislodges and removes particulates that would not be removed by prior art techniques. A gas nozzle or knife may also be used with the light source to provide an air or other gas assist mechanism to further enhance contaminant removal and pad reconditioning. The cleaning is preferably done by application of the light energy at a shallow incidence angle relative to the plane of the pad surface.

The present invention has a number of advantages over prior art processes. Since it is a non-contact process, it results in substantially less deterioration of or damage to the polishing pad, particularly when compared with abrasive conditioners that remove the contaminating layer adjacent to the pad surface. Also, abrasive conditioners wear relatively rapidly and have unpredictable life times, whereas the light energy source of the present invention may be monitored and controlled to assure constant and repeatable process parameters. Also, the wearing of abrasive conditioners provide an additional source of polishing pad contamination, which is avoided by the present invention.

The present invention can be incorporated in new or existing CMP polishing devices with minimal modification of existing designs so as to apply the light energy to conventional polishing pads to clean the pads while they remain in place after periodic intervals of polishing operations. The light source and optics providing the light energy can easily be scanned to provide complete coverage of the portions of the pad over which polishing takes place, and such scanning can also be used to displace dislodged contaminants over and beyond the edge of the platen on which the pad is carried.

The use of a laser, a collimated beam or other light source also provides the capability of adjusting the grazing angle of the light beam relative to the plane of the pad surface so that the illuminated area can be used as a knife edge to selectively remove coated and embedded contaminants instead of pad material. Thus, a shallow grazing angle provides a shallow penetration below the polishing pad surface and can be limited to the shallow depth of a contaminated layer. The energy density at the work surface of the pad also may be precisely controlled by adjusting one of the various degrees of freedom provided by a light source, such as frequency, energy output, focus, duty cycle and like.

BRIEF DESCRIPTION OF THE DRAWINGS

The structure, operation and advantages of the invention may be better understood from the following detailed description of the preferred embodiments taken in conjunction with the attached drawings, in which.

DETAILED DESCRIPTION OF PREFERRED EMBODIMENTS

Figure 2:
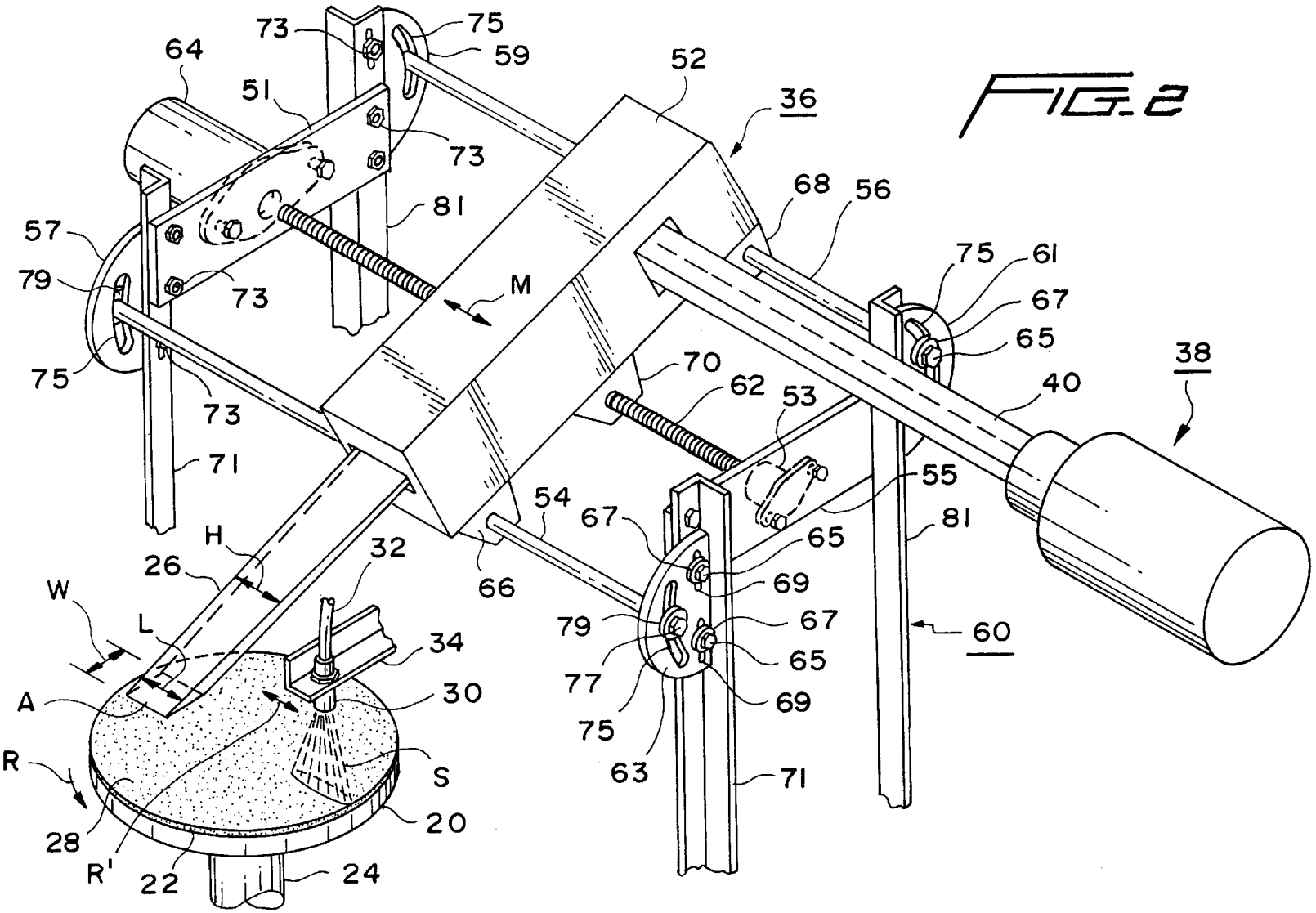
FIG. 2 is a perspective view of the apparatus of the invention.
Figure 3:
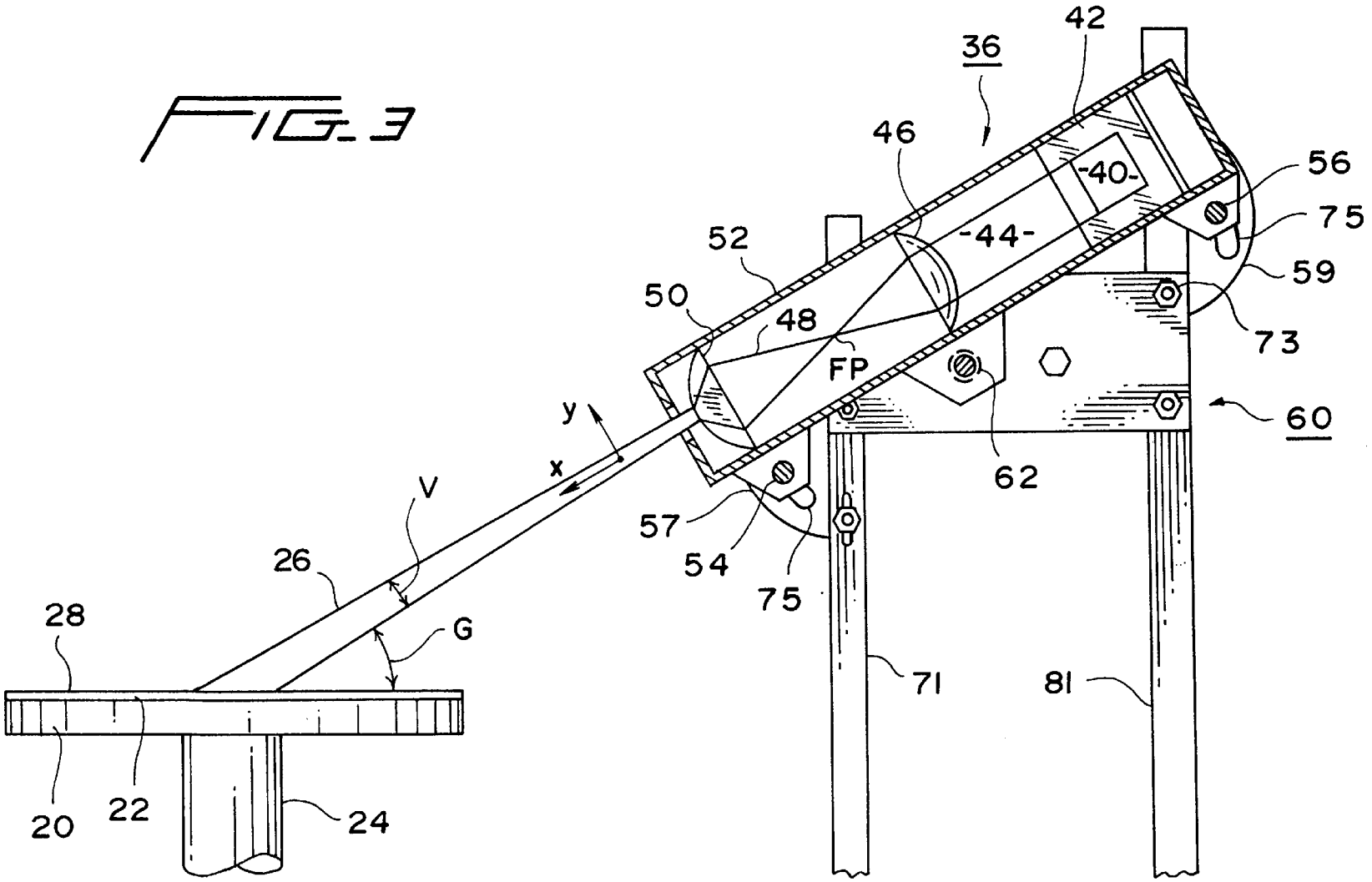
FIG. 3 is an elevational view of the apparatus of FIG. 2.
Figure 4:
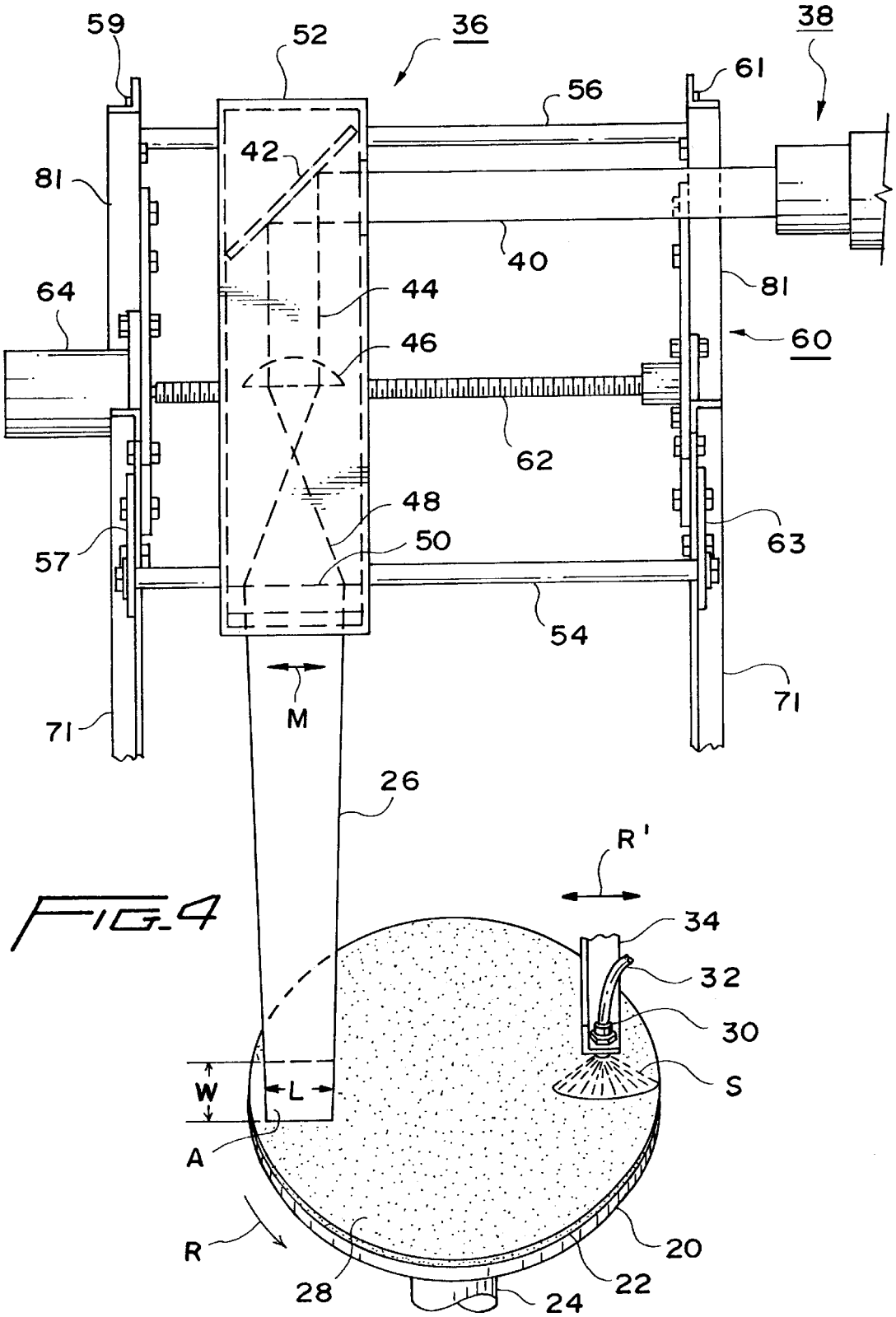
FIG. 4 is a plan view of the invention taken perpendicular to a plane defined by the width of the light beam.

With reference to FIGS. 2–4, the polishing pad cleaning apparatus and method of the present invention are illustrated. The cleaning apparatus may be used in conjunction with a polishing apparatus used to planarize a thin film layer formed over a substrate of a semiconductor wafer. The thin film is typically an intermetal dielectric layer formed between two metal layers of a semiconductor device. The polisher has a platen 20 and a polishing pad 22 supported on the platen and attached thereto with an adhesive compound (not shown). The platen 20 is carried for rotation in either direction by a drive shaft 24.

In the present invention, the contaminants adhering as a coating and/or embedded in the surface of the polishing pad 22 are removed by a high intensity light beam 26 that is focused to irradiate an irradiated area A having a length L and a width W. The length L results from the horizontal dimension H of the incident light beam and the width W results from the vertical dimension V of the incident light beam, but the width W is significantly greater than the vertical dimension V due to the projection caused by the grazing angle G between the plane of the light beam and the plane containing the planer surface of the polishing pad. As the grazing angle G becomes less, the width W will increase.

The surface 28 of the pad 22 is preferably irradiated in the presence of water or some other vaporizable liquid that may be applied to the surface of the pad as a fan-shaped spray S issuing from a nozzle 30 supplied with the liquid via a conduit 32 connected to a source of pressurized liquid (not shown). Alternatively, the liquid may be supplied from a feed tube (not shown) located above the center of the polishing pad 22, the deposited liquid then being distributed centrifugally over the pad surface by rotation of the platen 20. The vaporization of the water or other liquid to steam or vapor by heat energy from the light beam aids in releasing the coated and/or imbedded particles from the pad material.

As may be seen best in FIGS. 3 and 4, the light beam 26 is a laser beam or other collimated and/or focused light beam provided by an optical system, generally designated 36, which includes a laser or other light source 38. Issuing from light source 38 is a relatively broad three-dimensional beam 40 that typically may have a rectangular cross section. The beam 40 is reflected by a mirror 42 as a reflected beam 44 that may have substantially the same large cross section as beam 40. Beam 44 passes through a spherical focus lens 46 for providing a focused beam 48 having a focal point FP by way of example. However, the beam 48 need not have a focus where the lens 46 is a negative lens which provides input to the positive cylindrical lens. The lens system may be Galilean, Newtonian, Telecentric, or any other combination of lenses capable of providing the high intensity light beam 26. The cylindrical lens 50 condenses the beam 48 along the y-axis perpendicular to its directional axis X (FIG. 3) to provide the thin concentrated beam 26, which preferably has a thin rectangular cross section with a small vertical dimension V relative to a much larger horizontal dimension H.

The mirror 42 and the lenses 46 and 50 are mounted in a housing 52, which is arranged for reciprocal sliding movement along a pair of parallel guide rods 54 and 56 mounted on a frame, generally designated 60. To provide the grazing angle G, the housing 52 is tilted or inclined downward from back to front by making the rear legs 81, 81 of frame 60 extend vertically to a higher level than the front legs 71, 71 of frame 60. The housing 52 may be moved laterally back and forth along the guide rods 54 and 56 in a reciprocal motion represented by the arrow M by a threaded lead screw 62, which is mounted for rotation on the frame 60 and driven in either rotational direction by a reversible electric motor 64. The motor 64 is secured by bolts to a cross member 51 of frame 60 and the distal end of lead screw 62 is journaled for rotation in a bearing 53 bolted to a cross member 55 of frame 60. The guide rods 54 and 56 pass through respective journal blocks 66 and 68 carried beneath the housing 52, and the lead screw 62 engages an internally threaded drive block 70 carried beneath the housing 52.

The platen 20 preferably rotates, as represented by the arrow R, to move the pad surface 28 rapidly through the irradiated area A. Reciprocal movement of the housing 52 causes corresponding reciprocal movement of the irradiated area A of light beam 26 in a radial direction across the surface 28 of the polishing pad 22. The range of such reciprocal radial movement may be relatively small because the irradiated area A does not need to go past the rotational axis of drive shaft 24. In addition, a central portion of pad 22 would not be contaminated where polishing of the silicon wafers takes place over only an annular outer portion of the polishing pad surface 28.

The water nozzle 30 is carried by a frame member 34 that also may be mounted for reciprocal motion for causing the water spray S to reciprocate radially back and forth across the surface 28 of the pad 22 as indicated by the arrow R' in FIG. 2. Alternatively, nozzle 30 or a feed tube may be in a fixed position at or near the center of the pad surface and centrifugal force relied upon to spread the discharged water across the remainder of the pad surface.

The optical assembly 36 is adjustable vertically by means of four identical brackets 57, 59, 61 and 63, each releasably secured to one of the angle iron frame members 71 and 81 by a pair of bolts 65, 65 that pass through clamping washers 67, 67 and slots 69, 69 in the corresponding adjustment bracket. The bolts 65, 65 then pass through holes in the frame members and, on the inside thereof, engage the threads of corresponding nuts 73, 73. Adjustments in the tilt or inclination of the optical assembly 36 relative to the plane of polishing pad 22, to thereby change the beam incidence angle G, are provided by an arcuate slot 75 in each bracket, through which passes a bolt 77 having a clamping washer 79 and engaging a threaded bore (not shown) in the corresponding end of guide rod 54 or 56.

Figure 5:
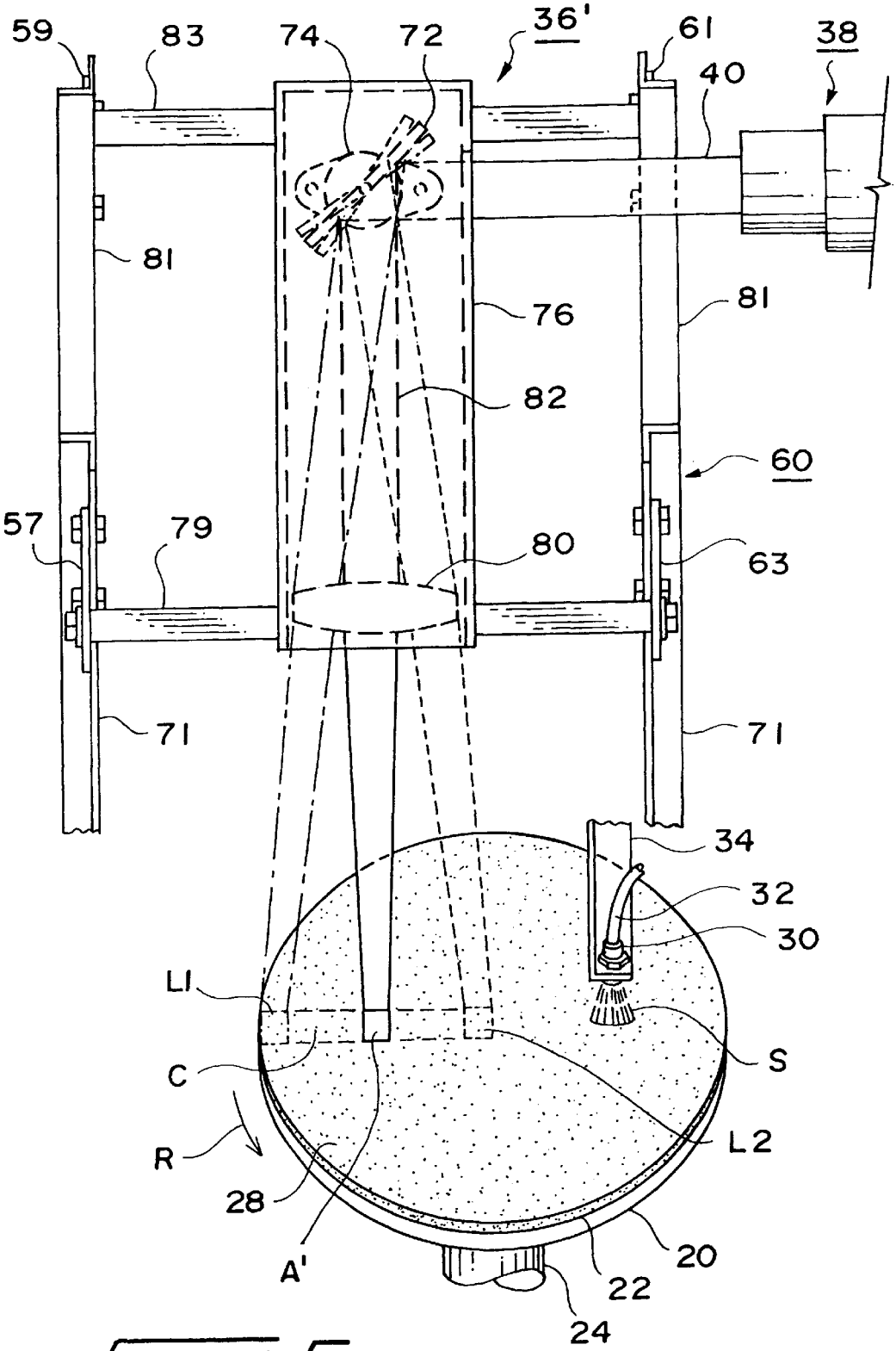
FIG. 5 is a plan view similar to FIG. 4 showing a modification of the invention wherein light beam scanning of the polishing pad is provided by an oscillating or rotating mirror.

Referring now to FIG. 5, there is shown a modified optical assembly 36' wherein an irradiated area A' is cause to reciprocate radially across the pad surface 28 between locations L1 and L2 by oscillating a mirror 72 with a galvanometer 74. The mirror 72 is mounted for such oscillatory movement in a housing 76 on which the galvanometer 74 is also mounted. Also mounted in casing 76 is a lens 80 for focusing a reflected laser or collimated beam 82 onto the pad surface 28. As a further alternative, the oscillating mirror 72 may be replaced by a rotating mirrored polygon (not shown) driven in rotation by an electric motor mounted in place of galvanometer 74.

Since the light source and mounting frame may be the same as those of the first embodiment described above, the same numerals have been used in FIG. 5 to designate the same elements of these components. However, the casing 76 is mounted in a fixed lateral position on the frame 60 relative to the rotational axis of the platen 20 by fixing the casing 76 to front and rear lateral members 79 and 83. Lateral members 79 and 83 are in turn adjustably secured to frame 60 by brackets 57, 59, 61 and 63 for vertical and tilting adjustments of casing 76 relative to the pad surface 28 in the same manner as for casing 52.

Figure 1:
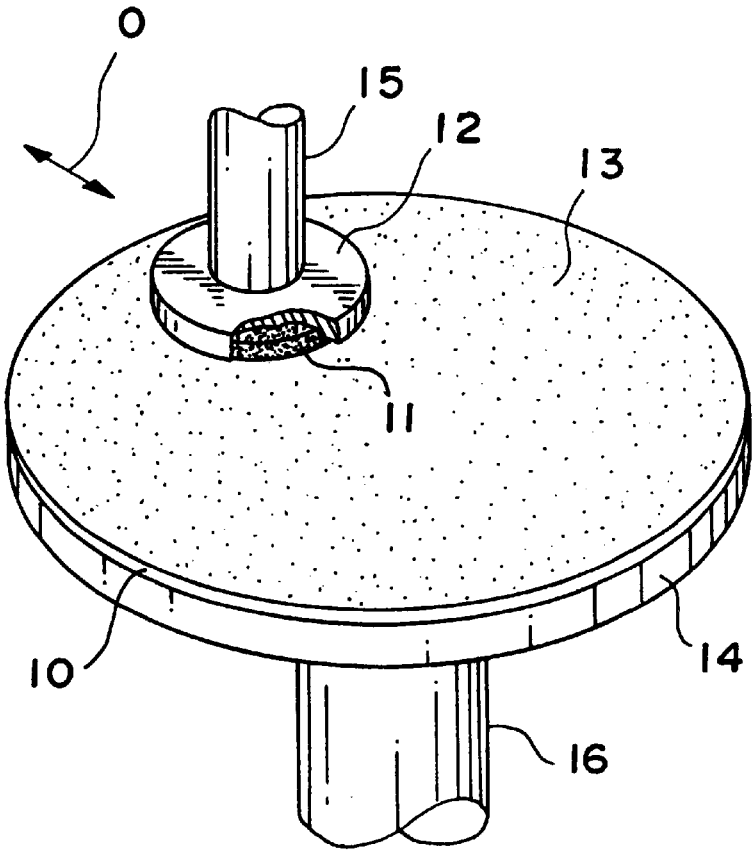
FIG. 1 PRIOR ART
FIG. 1 is a perspective diagrammatic illustration of a diamond grit conditioner that is one prior art technique for reconditioning the polishing surface of a polishing pad contaminated by its prior use in a CMP process.
Figure 7:
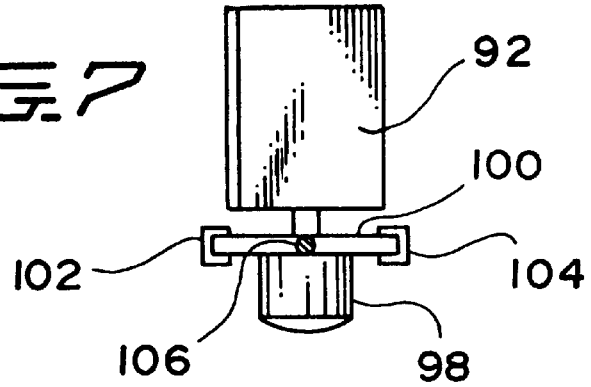
FIG. 7 is a sectional elevational view taken along line 7—7 of FIG. 6.
Figure 6:
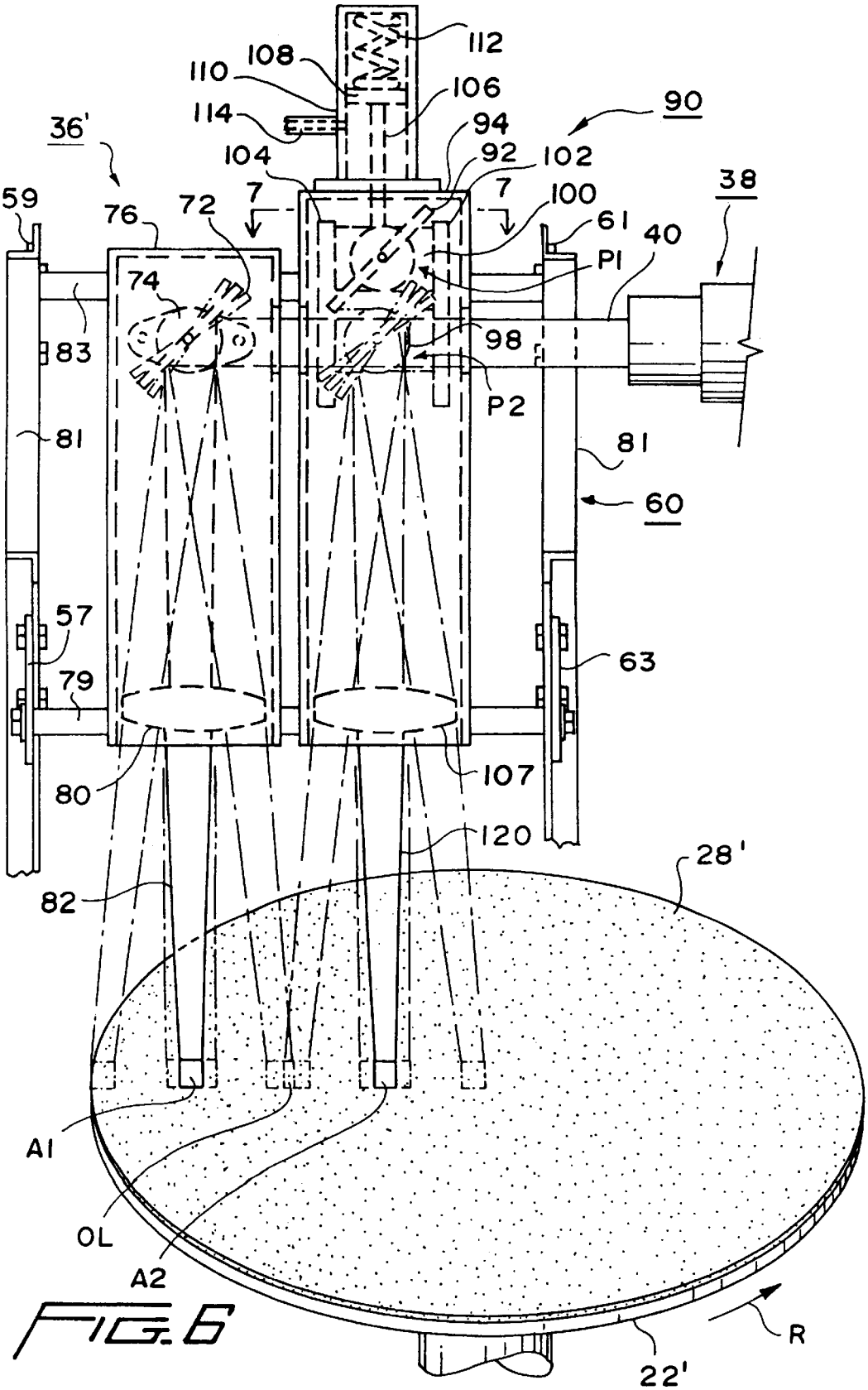
FIG. 6 is a plan view similar to FIG. 5 showing a further modification of the invention wherein a second oscillating or rotating mirror is used to expand coverage of the light beam scanning of the pad.

In FIG. 6 and 7, there is shown a further modification of the invention wherein a greater pad area or a larger polishing pad surface 28' is covered by the use of two optical systems, generally designated 36' and 90, respectively. As the optical system 36' and the mounting frame 60 may be the same as those of the FIG. 5 embodiment described above, the same numerals have been used in FIG. 6 to designate the same elements of these components. As is housing 76, the second housing 94 is similarly fixed to the frame 60. Also similar to the FIG. 5 embodiment, the second mirror 92 is oscillated by a galvanometer 98 to provide an oscillating light beam 120. However, only one of the two light beams 82 and 120 is provided at a time because when the mirror 92 is reciprocated from a retracted position P1 to an extended position P2, the mirror 92 intercepts the source light beam 40 and thereby prevents it from reaching the more distant mirror 72.

To move the mirror 92 from its extended position P2 to its retracted position P1, the optical assembly 90 includes a piston 108 arranged for reciprocating movement in a fluid cylinder 110 and connected to a shuttle 100 by a piston rod 106. As may be seen best in FIG. 7, the shuttle 100 is mounted for reciprocal movement in a pair of guide tracks 102 and 104 and carries the mirror 92 and its galvanometer 98.

The shuttle 100 and the mirror elements carried thereon are moved to the retracted position P1 when the cylinder 110 is pressurized by fluid entering the cylinder 110 through a supply line 114, which causes the piston 108 to compress a return spring 112. When the mirror 92 is in its retracted position P1, the source beam 40 is allowed to pass through the housing 94 and into the housing 76, where it is reflected by the oscillating mirror 72 and relayed through the optical lens 80 to the pad surface 28' as the focused light beam 82. The light beam 82 is thereby caused to oscillate over a sufficient radial distance to cover an outer section of the surface 28' of polishing pad 22'. When the cylinder 110 is not pressurized to actuate the piston 108, the spring 112 returns the mirror 92 to its extended position P2, in which position this mirror relays the source beam 40 through the optical lens 107 to the polishing pad surface 28' as the focused light beam 120. The oscillation of beam 120 covers an inner section of the polishing pad surface 28'. The irradiated area A1 by beam 82 preferably overlaps the irradiated area A2 by beam 120 to provide an overlap area OL, which is at the inner limit of the oscillation of beam 82 and the outer limit of the oscillation of beam 120.

The dual optical system arrangement of the FIG. 6 allows a piston and shuttle to take the place of the lead screw and motor assembly used in the embodiment of FIGS. 2–4. Such a dual optical system may be significantly less expensive compared to the lead screw and motor assembly, and may also require significantly less maintenance. A similar dual optical system may employ two fixed housings as in FIG. 6 each with a fixed mirror as in FIG. 4, but in this alternative, the housings would be canted relatively to each other so that the projected beams would have an overlap similar to the overlap OL in FIG. 6. It more area is required to be covered in either of the foregoing alternatives, such as for the purpose of extending coverage over the entire diameter of the pad, these arrangements may be duplicated by additional housings each with a retractable mirror similar to mirror 92.

The above two alternatives for moving the mirror relative to the casing are known as Pre-Objective Scanners. When the mirrored surface changes its angle relative the incident beam 40, the mirrored surface directs the beam at a different angle and position into the lens 80. The lens 80 then focuses the reflected beam 82 at different locations between the limit locations represented by locations L1 and L2 so as to fully cover the scanned area C on the surface 28 of pad 22. The advantages of Pre-Objective Optical Systems as shown in FIG. 5 are their high scan speed and their ability to have a focused image at the scanned surface. However, for the scanning beam to stay in focus, the lens 80 must be large and the optics relatively complex and expensive.

A less expensive alternative is a telecentric optical system that allows the center of the scanning beam of light to impinge on a work surface orthogonally throughout its scan. Accordingly, while a Pre-Objective Optical System has been illustrated in FIG. 5, less expensive telecentric scanning systems may be available, such as those shown and described in U.S. Pat. No. 5,620,618 in the name of Freedenberg, et al., and assigned to the same assignee as the present disclosure. The entire contents of said U.S. Pat. No. 5,620,618 are incorporated herein by reference.

The preferred light source is an excimer laser having output energy preferably in the range of 20 to 2,000 mj and a frequency preferably in the range of 20 to 1,000 hz. The rotational speed at the edge of the platen during reconditioning is preferably in the range of 10 to 500 millimeters per second at an incidence angle G in the range of 0° to 90°, preferably 5° to 45°, more preferably 10° to 30°. The size of the irradiated area A preferably has a length in the range of 5 to 25 cm, more preferably 10 to 21 cm and most preferably about 21 cm; and a width W in the range of 0.1 to 0.8 cm, preferably 0.2 to 0.6 cm, more preferably about 0.3 cm.

A preferred laser light source is a XeCl excimer providing a minimum output energy of 100 mj at a wave length of 308 nanometers and a frequency of 50 to 500 hz. A more preferred laser light source is a KrF excimer providing a minimum output energy of 50 mj at a wavelength of 248 nanometers and a frequency of 50 to 200 hz. A most preferred laser light source is an ArF excimer providing a minimum output energy of 20 mj at a wavelength of 193 nanometers and a minimum frequency of 50 hz.

As one specific example using an ArF excimer, the output energy density is 50 mj/cm$^2$ at a frequency of 100 hz with an average linear scanning speed of 10 mm per second, an incidence angle of 15°, and an irradiated area A measuring about 10 cm in length and 0.3 cm in width. Where the light source is a laser, the preferred energy density in the irradiated area A at the work surface of the polishing pad is preferably in the range of 800 to 3000 mj/cm$^2$, more preferably 800 to 2000 mj/cm$^2$, and most preferably 800 to 1200 mj/cm$^2$. A power density at the work surface of 1000 mj/cm$^2$ may be achieved by an ArF excimer operating at a wavelength of 193 nanometers and delivering at the work surface a peak power of 100 megawatts per cm$^2$ per pulse of 10 nanosecond duration, and at a frequency of 100 hz (100 pulses per second). As will be understood by persons skilled in the art, the parameters of this example are scalable to decrease the pad reconditioning time, such as by increasing the energy density and increasing the platen rotational speed.

Instead of a laser, the light source may be a mercury arc lamp with a collimating optical system for providing collimated ultraviolet light, such as ultraviolet light with a wavelength in the range of 365 to 410 nanometers. The output power of the arc lamp may be in the range of 300 to 600 watts per inch. The radiation density provided in the irradiated area at the work surface may be significantly less than that provided by a laser since mercury arc lamp irradiation is based on continuous average power rather than short pulses of high peak power.

Persons skilled in the art, upon learning of the present disclosure, will recognize that various modifications to the elements and steps of the invention are possible without significantly effecting their functions. For example, the light sources and optical arrangements described above may be varied widely in accordance with technology currently available for providing concentrated beams of light. Similarly, means other than those disclosed may be used to cause the light beam to scan and the liquid spray to move across the contaminated surface of the polishing pad. In addition, the polishing pad itself may be reciprocated laterally past a fixed light beam to produce the same relative movement between the light beam and the pad as provided by a scanning light source. Accordingly, while the preferred embodiments have been shown and described in detail by way of example, further modifications and embodiments are possible without departing from the scope of the invention as defined by the claims set forth below.

What is claimed is:

1. A method for cleaning a polishing surface of a polishing pad containing polishing debris embedded in features of said polishing surface, said method comprising steps of:

supporting the pad to be cleaned on a supporting surface with the polishing surface exposed;

wetting features of the polishing surface of the pad with a liquid; and irradiating the wetted surface features of the pad with a beam of light of sufficient intensity to vaporize a sufficient portion of said liquid for the vaporized liquid to cause at least a portion of said embedded debris to be dislodged and expelled from said surface features without removing said features of the polishing surface of the pad.

2. A method according to claim 1 further comprising a step of causing relative movement between said pad surface and said light beam.

3. A method according to claim 2, wherein said light beam moves relative to said pad surface.

4. A cleaning method according to claim 3, wherein movement of said light beam is caused by movement of a mirror reflecting said light beam towards said pad surface.

5. A cleaning method according to claim 4, wherein said mirror is mounted in a housing arranged for movement in a lateral direction relative to said reflected light beam, and said housing is caused to reciprocate in said lateral direction.

6. A cleaning method according to claim 4, wherein said mirror is mounted in a housing having a fixed position relative to said pad surface, and wherein said relative movement of the light beam is caused by relative motion between said mirror and said housing.

7. A cleaning method according to claim 2, wherein said pad surface moves relative to said light beam and said liquid is water.

8. A cleaning method according to claim 7, wherein said supporting surface is mounted for rotation so that at least a portion of said pad surface rotates past an intersection between said light beam and said pad surface.

9. A method according to claim 1, wherein said light beam is a focused light beam provided by a laser, and the energy of said light beam at the surface of said pad is a minimum of 250 mj/cm$^2$.

10. A cleaning method according to claim 1, wherein said light beam is telecentric.

11. A cleaning method according to claim 1, wherein said irradiating step comprises reflecting a source beam of light towards said pad surface with a first mirror to provide a first beam of light of sufficient intensity to vaporize at least a portion of said liquid, and reflecting said source beam of light toward said pad surface with a second mirror to provide a second beam of light of sufficient intensity to vaporize at least a portion of said liquid; and wherein said second mirror is movable between a first position out of a path of said source beam to said first mirror, and a second position in said path to intercept said source beam before it reaches said first mirror.

12. A method according to claim 1, wherein said surface features are waves, holes, creases, ridges, slits, depressions, protrusions, gaps, or pores.

13. An apparatus for cleaning a polishing surface of a polishing pad containing polishing debris embedded in features of said polishing surface, said apparatus comprising:

a support having a surface for supporting the pad with the polishing surface exposed;

a nozzle arranged to wet features of the polishing surface of the pad with a liquid spray; and an optical system arranged to irradiate the wetted surface features of the pad with a beam of light of sufficient intensity to vaporize a sufficient portion of said liquid for the vaporized liquid to cause at least a portion of said embedded debris to be dislodged and expelled from said surface features without removing said features of the polishing surface of the pad.

14. An apparatus according to claim 13 further comprising a means for causing relative movement between said pad surface and said light beam.

15. A cleaning apparatus according to claim 14, wherein said movement means comprises a drive mechanism arranged to cause said pad surface to move relative to said light beam, and wherein said liquid is water.

16. A cleaning apparatus according to claim 15, wherein said supporting surface is mounted for rotation and said drive mechanism rotates said supporting surface so that at least a portion of said pad surface rotates past an intersection between said light beam and said pad surface.

17. An apparatus according to claim 13, comprising a means for causing said light beam to move relative to said pad surface.

18. A cleaning apparatus according to claim 17, wherein said movement means comprises a mirror for reflecting said light beam towards said pad surface, and a drive mechanism for moving a said mirror to cause said light beam to move relative to said pad surface.

19. A cleaning apparatus according to claim 18, wherein said mirror is mounted in a housing arranged for movement in a lateral direction relative to a direction in which said light beam is reflected by said mirror, and wherein said drive mechanism is arranged to caused said housing to reciprocate in said lateral direction.

20. A cleaning apparatus according to claim 18, wherein said mirror is mounted in a housing having a fixed position relative to said pad surface, and wherein said drive mechanism is arranged to caused relative motion between said mirror and said housing such that said light beam is caused to move across said pad surface.

21. A cleaning apparatus according to claim 13, wherein said light beam is a focused light beam provided by a laser and the energy of said light beam at the surface of said pad is a minimum of 250 mj/cm$^2$.

22. A cleaning apparatus according to claim 13, wherein said light beam is telecentric.

23. A cleaning apparatus according to claim 13, wherein said optical system comprises a first mirror arranged to reflect a source beam of light towards said pad surface to provide a first beam of light of sufficient intensity to vaporize at least a portion of said liquid, a second mirror arranged to reflect said source beam of light towards said pad surface to provide a second beam of light of sufficient intensity to vaporize at least a portion of said liquid, and a reciprocating shuttle arranged to move said second mirror between a first position out of a path of said source beam to said first mirror and a second position in said path to intercept said source beam before it reaches said first mirror.

24. An apparatus according to claim 13, wherein said surface features are waves, holes, creases, ridges, slits, depressions, protrusions, gaps, or pores.

25. An apparatus for cleaning a polishing surface of a polishing pad containing polishing debris in features of said polishing surface, said apparatus comprising:

a support having a surface for supporting the pad with the polishing surface exposed;

a liquid source arranged to wet the polishing surface of the pad with a liquid; and an optical system arranged to irradiate the wetted surface of the pad with a beam of light of sufficient intensity to vaporize at least a portion of said liquid such that the vaporized liquid causes at least a portion of said debris to be expelled from said features without removing said features of the polishing surface of the pad;

said optical system comprising a first mirror arranged to reflect a source beam of light towards said pad surface to provide a first beam of light of sufficient intensity to vaporize at least a portion of said liquid, a second mirror arranged to reflect said source beam of light towards said pad surface to provide a second beam of light of sufficient intensity to vaporize at least a portion of said liquid, and a reciprocating shuttle arranged to move said second mirror between a first position out of a path of said source beam to said first mirror and a second position in said path to intercept said source beam before it reaches said first mirror.

* * * * *